US008002039B2

(12) United States Patent
Coon et al.

(10) Patent No.: US 8,002,039 B2
(45) Date of Patent: Aug. 23, 2011

(54) VALVE FOR CONTROLLING THE FLOW OF FLUID BETWEEN AN INTERIOR REGION OF THE VALVE AND AN EXTERIOR REGION OF THE VALVE

(75) Inventors: Robert J. Coon, Missouri City, TX (US); Khai Tran, Pearland, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 247 days.

(21) Appl. No.: 12/365,634

(22) Filed: Feb. 4, 2009

(65) Prior Publication Data

US 2009/0134352 A1 May 28, 2009

Related U.S. Application Data

(62) Division of application No. 11/101,687, filed on Apr. 8, 2005, now Pat. No. 7,500,523.

(51) Int. Cl.
*E21B 34/08* (2006.01)

(52) U.S. Cl. ..... 166/321; 166/334.1; 166/334.4; 166/373

(58) Field of Classification Search ..... 166/319, 166/321, 334.4, 318, 334.1, 373
See application file for complete search history.

(56) References Cited

U.S. PATENT DOCUMENTS

| | | | | |
|---|---|---|---|---|
| 3,713,490 | A * | 1/1973 | Watson | 166/305.1 |
| 4,522,266 | A | 6/1985 | Barrington | |
| 4,557,333 | A | 12/1985 | Beck | |
| 4,721,162 | A | 1/1988 | Pringle et al. | |
| 5,156,207 | A | 10/1992 | Haugen et al. | |
| 5,390,737 | A | 2/1995 | Jacobi et al. | |
| 5,826,657 | A | 10/1998 | Ringgenberg | |
| 6,289,990 | B1 | 9/2001 | Dillon et al. | |
| 6,328,111 | B1 | 12/2001 | Bearden et al. | |
| 6,354,378 | B1 | 3/2002 | Patel | |
| 6,585,048 | B1 | 7/2003 | Heijnen | |

FOREIGN PATENT DOCUMENTS

| | | |
|---|---|---|
| GB | 2314106 | 12/1997 |
| WO | WO-0106086 | 1/2001 |

OTHER PUBLICATIONS

"DHMV" Automatic Downhole Master Valve, Dresser Oil Tools, Dallas, Texas, no date available.

* cited by examiner

*Primary Examiner* — Giovanna C Wright
(74) *Attorney, Agent, or Firm* — Patterson & Sheridan, L.L.P.

(57) ABSTRACT

Embodiments of the invention are directed to a valve. In one embodiment, the valve includes a body having a first biasing member and a sealing member configured to axially move inside the body against the first biasing member to provide a path for fluid to flow from an interior region of the body to an exterior region of the body at a first predetermined pressure difference across the sealing member.

43 Claims, 5 Drawing Sheets

VALVE FOR CONTROLLING THE FLOW OF FLUID BETWEEN AN INTERIOR REGION OF THE VALVE AND AN EXTERIOR REGION OF THE VALVE

CROSS-REFERENCE TO RELATED APPLICATIONS

This application is a divisional of U.S. patent application Ser. No. 11/101,687, filed Apr. 8, 2005 now U.S. Pat. No. 7,500,523, which is herein incorporated by reference.

BACKGROUND OF THE INVENTION

1. Field of the Invention

Various embodiments of the present invention generally relate to producing formation fluid from a reservoir, and more particularly, to controlling the flow of fluids between the reservoir and the annulus region.

2. Description of the Related Art

A completion string may be positioned in a well to produce fluids from one or more formation zones. Completion devices may include casing, tubing, packers, valves, pumps, sand control equipment and other equipment to control the production of hydrocarbons. During production, fluid flows from a reservoir through perforations and casing openings into the wellbore and up a production tubing to the surface. The reservoir may be at a sufficiently high pressure such that natural flow may occur despite the presence of opposing pressure from the fluid column present in the production tubing. However, over the life of a reservoir, pressure declines may be experienced as the reservoir becomes depleted. When the pressure of the reservoir is insufficient for natural flow, artificial lift systems may be used to enhance production. Various artificial lift mechanisms may include pumps, gas lift mechanisms, and other mechanisms. One type of pump is the electrical submersible pump (ESP).

An ESP normally has a centrifugal pump with a large number of stages of impellers and diffusers. The pump is driven by a downhole motor, which is typically a large three-phase AC motor. A seal section separates the motor from the pump for equalizing internal pressure of lubricant within the motor to that of the well bore. Often, additional components may be included, such as a gas separator, a sand separator and a pressure and temperature measuring module. Large ESP assemblies may exceed 100 feet in length.

An ESP is typically installed by securing it to a string of production tubing and lowering the ESP assembly into the well. The string of production tubing may be made up of sections of pipe, each being about 30 feet in length.

If the ESP fails, the ESP may need to be removed from the wellbore for repair at the surface. Such repair may take an extended amount of time, e.g., days or weeks. When the ESP is removed from the wellbore, some action is typically taken to ensure that formation fluid does not continue to flow to the surface. This is typically done, for example, by applying some type of heavy weight fluid (also commonly referred to as "kill fluid") into the wellbore to "kill" the well, i.e., to prevent fluid flow from the reservoir to the surface during work-over operations. The hydrostatic pressure from the kill fluid is typically greater than the reservoir pressure. However, when the reservoir pressure exceeds the hydrostatic pressure, fluid from the reservoir often flows to the surface during work-over operations. In some instances, the "kill" fluid might damage the reservoir making it harder to recover the oil later.

Therefore, a need exists in the art for an improved apparatus and system for controlling the flow of fluid between the reservoir and the surface.

SUMMARY OF THE INVENTION

Embodiments of the invention are directed to a valve. In one embodiment, the valve includes a body having a first biasing member and a sealing member configured to axially move inside the body against the first biasing member to provide a path for fluid to flow from an interior region of the body to an exterior region of the body at a first predetermined pressure difference across the sealing member.

In another embodiment, the valve includes a body having a first seat, a second seat and a sealing member movable between the first seat and the second seat, wherein the sealing member is configured to move the second seat against a first biasing member to provide a path for fluid to flow from an interior region of the body to an exterior region of the body at a first predetermined pressure difference across the sealing member.

Embodiments of the invention are also directed to a method for controlling fluid flow between an interior region and an exterior region of a valve. In one embodiment, the method includes disposing the valve inside a wellbore. The valve comprises a body having a sealing member and a first biasing member biased against the sealing member in a first direction. The method further includes moving the sealing member in a second direction inside the body against the first biasing member to provide a path for fluid to flow from an interior region of the body to an exterior region of the body at a first predetermined pressure difference across the sealing member.

In another embodiment, the method includes disposing the valve inside a wellbore. The valve comprises a body having a first seat and a first biasing member biased against the first seat in a first direction. The method further includes moving the first seat in a second direction against the first biasing member to provide a path for fluid to flow from an interior region of the body to an exterior region of the body at a first predetermined pressure difference across the sealing member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
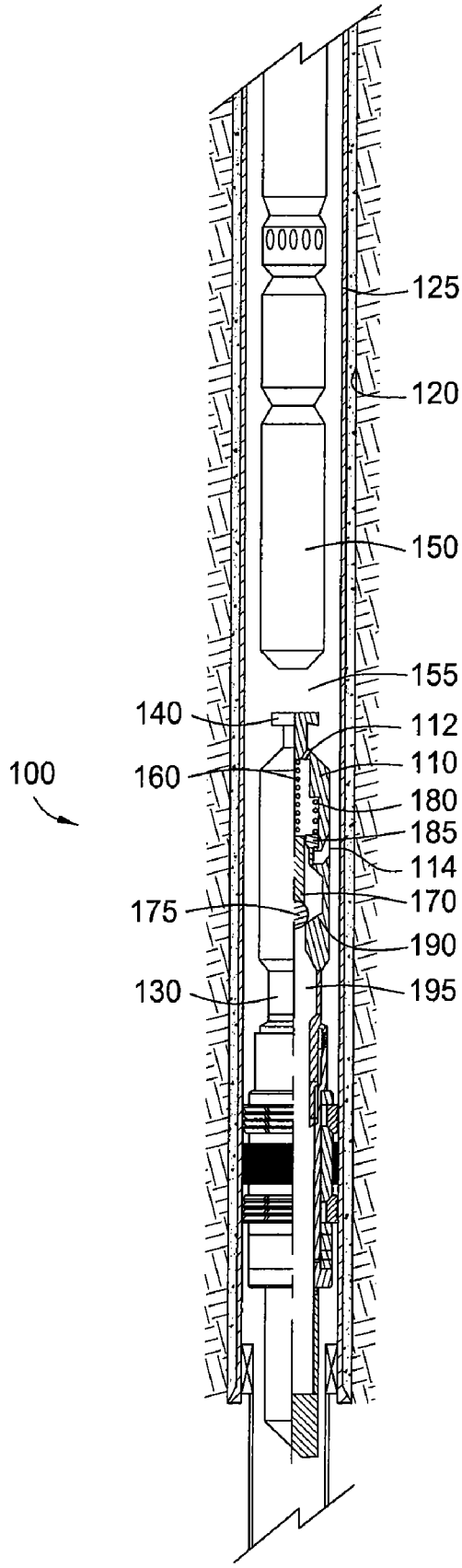
FIG. 1 illustrates a partial sectional view of a control valve in accordance with one or more embodiments of the invention.

FIG. 1 illustrates a partial sectional view of a control valve 100 in accordance with one or more embodiments of the invention. The control valve 100 may be disposed on a string of tubulars 130 inside a casing 125 within a wellbore 120. An electrical submersible pump 150 may be disposed above the control valve 100. The electrical submersible pump 150 serves as an artificial lift mechanism, driving production fluids from the bottom of the wellbore 120 to the surface. The electrical submersible pump 150 may be disposed above the control valve 100 by a distance ranging from about 15 feet to about 300 feet. Although embodiments of the invention are described with reference to an electrical submersible pump, other embodiments contemplate the use of other types of artificial lift mechanism commonly known by persons of ordinary skill in the art.

The control valve 100 includes a neck 140, which is retrievable from the surface by an external fishing tool or other retrieval means commonly by persons of ordinary skill in the art. The control valve 100 further includes a body 110, which includes a first spring 160 coupled to a sealing member 170, which has a ball portion 175. The sealing member 170 may also be referred to as a dart. The first spring 160 is configured to position the ball portion 175 against a lower seat 190, even in horizontal applications. The control valve 100 further includes a second spring 180 coupled to an upper seat 185, which is movable against the second spring 180 under certain conditions.

The control valve 100 further includes a first port 112 and a second port 114. The first port 112 is configured to allow fluid from an exterior region 155 of the control valve 100 (e.g., an annulus region) to flow into the control valve 100, and more specifically, a region inside the body 110 above sealing member 170. The second port 114 is configured to allow fluid (e.g., formation fluid) from an interior region 195 of the control valve 100 to flow to the exterior region 155 under certain conditions. In an initial position, the second port 114 is blocked by the upper seat 185. In an open position, the second port 114 is configured to allow fluid from the interior region 195 to flow through the second port 114 to the exterior region 155. Operations of the above referenced components are described in detail in the following paragraphs.

FIG. 1 illustrates an embodiment in which the electrical submersible pump 150 is turned off or removed to the surface. As previously mentioned, in the event that the electrical submersible pump 150 is removed from the wellbore 120, kill fluid is often introduced into wellbore 120 to ensure that formation fluid does not continue to flow to the surface. The kill fluid enters the control valve 100 through the first port 112 and exerts hydrostatic pressure against the sealing member 170. Likewise, in the event that the electrical submersible pump 150 is turned off, production fluid or upper completion fluid enters the control valve 100 through the first port 112 and exerts hydrostatic pressure against the sealing member 170. In this embodiment, the pressure of the interior region 195 (i.e., below the sealing member 170) is less than the pressure of the exterior region 155 (e.g., hydrostatic pressure from either the kill fluid or the production fluid). As such, the pressure of the exterior region 155 operates to push the ball portion 175 against the lower seat 190, thereby forming a seal between the ball portion 175 and the lower seat 190. This seal is configured to prevent fluid (e.g., kill fluid, production fluid or upper completion fluid) from the exterior region 155 to flow into the interior region 195 and to prevent fluid from the interior region 195 to flow to the exterior region 155.

Figure 2:
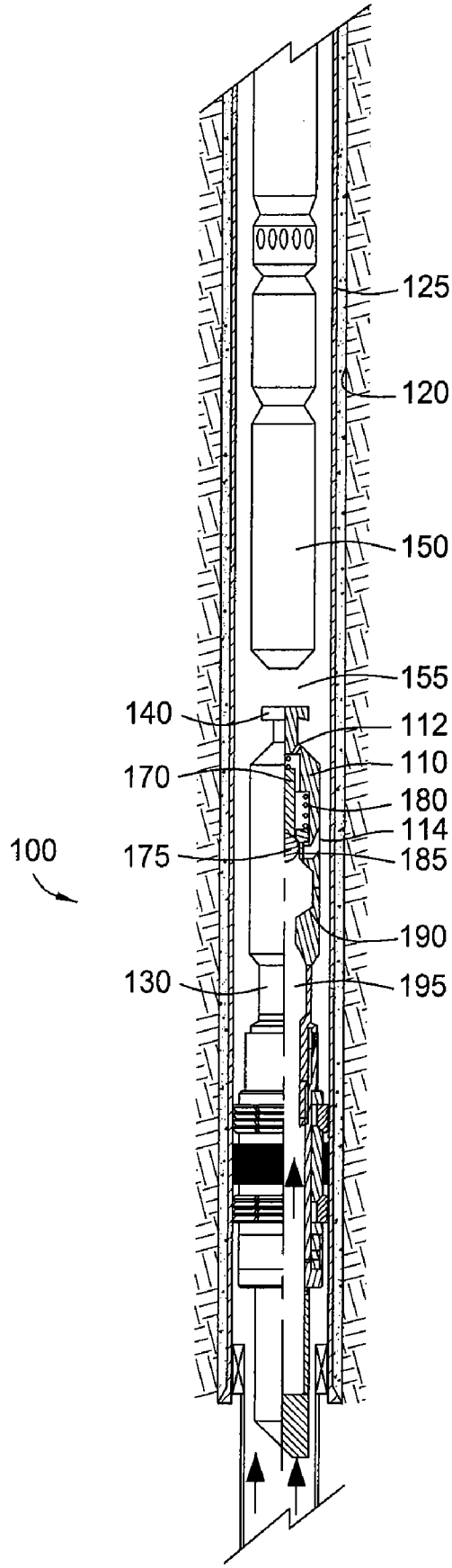
FIG. 2 illustrates the control valve in accordance with another embodiment of the invention.

FIG. 2 illustrates the control valve 100 in accordance with another embodiment of the invention. In this embodiment, the electrical submersible pump 150 is turned off or removed from the wellbore 120. Thus, hydrostatic pressure from either the kill fluid or the production fluid operates to push the ball portion 175 toward the lower seat 190. However, in this embodiment, the pressure of the interior region 195 (e.g., from formation fluid) is greater than the pressure of the exterior region 155 (e.g., from either the kill fluid or the production fluid) but less than the pressure exerted by the second spring 180 against the upper seat 185. As such, the pressure in the interior region 195 operates to push the sealing member 170, compressing the first spring 160, until the ball portion 175 is pressed against the upper seat 185, thereby forming a seal between the ball portion 175 and the upper seat 185. The second spring 180 may be configured to exert pressure against the upper seat 185 greater than the pressure of the interior region 195, e.g., the reservoir pressure. For example, the second spring 180 may be rated to exert pressure 1.2 times the amount of reservoir pressure. In this manner, the control valve 100 is configured to prevent fluid flow from the interior region 195 to the exterior region 155 and to prevent fluid flow from the exterior region 155 to the interior region 195, in the event that the electrical submersible pump 150 is turned off or removed from the wellbore 120 and the pressure of the interior region 195 is greater than the pressure of the exterior region 155 but less than the pressure exerted by the second spring 180 against the upper seat 185.

Figure 3:
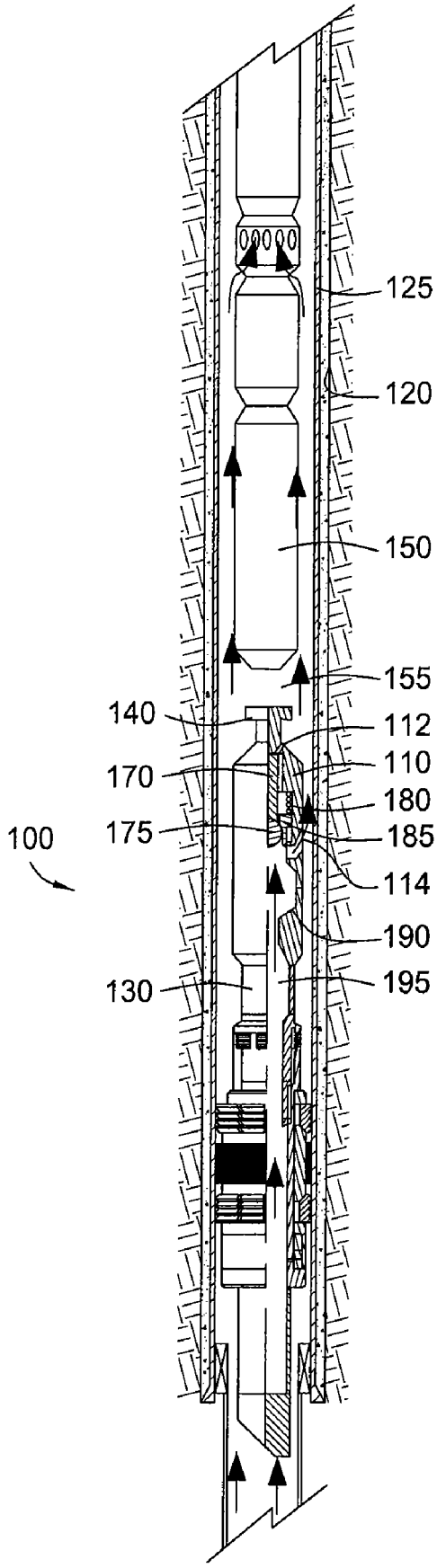
FIG. 3 illustrates the control valve in accordance with yet another embodiment of the invention.

FIG. 3 illustrates the control valve 100 in accordance with yet another embodiment of the invention. In this embodiment, the electrical submersible pump 150 is turned on, which creates a suction and operates to draw formation fluid to the surface. This negative pressure created by the electrical submersible pump 150 being turned on reduces the pressure of the exterior region (e.g., hydrostatic pressure from either the kill fluid or the production fluid), thereby allowing the pressure of the interior region 195 (e.g., reservoir pressure) to overcome the pressure of the exterior region 155 and the pressure exerted by the second spring 180 against the upper seat 185. As such, the pressure of the interior region 195 causes the sealing member 170 to push against the upper seat 185, which pushes against the second spring 180, until the upper seat 185 is removed from blocking the second port 114. When the second port 114 is open, fluid from the interior region 195 may flow out to the exterior region 155. In this manner, the control valve 100 is configured to allow fluid from the reservoir to flow through the control valve 100 to the surface only when the electrical submersible pump 150 is turned on.

Figure 4:
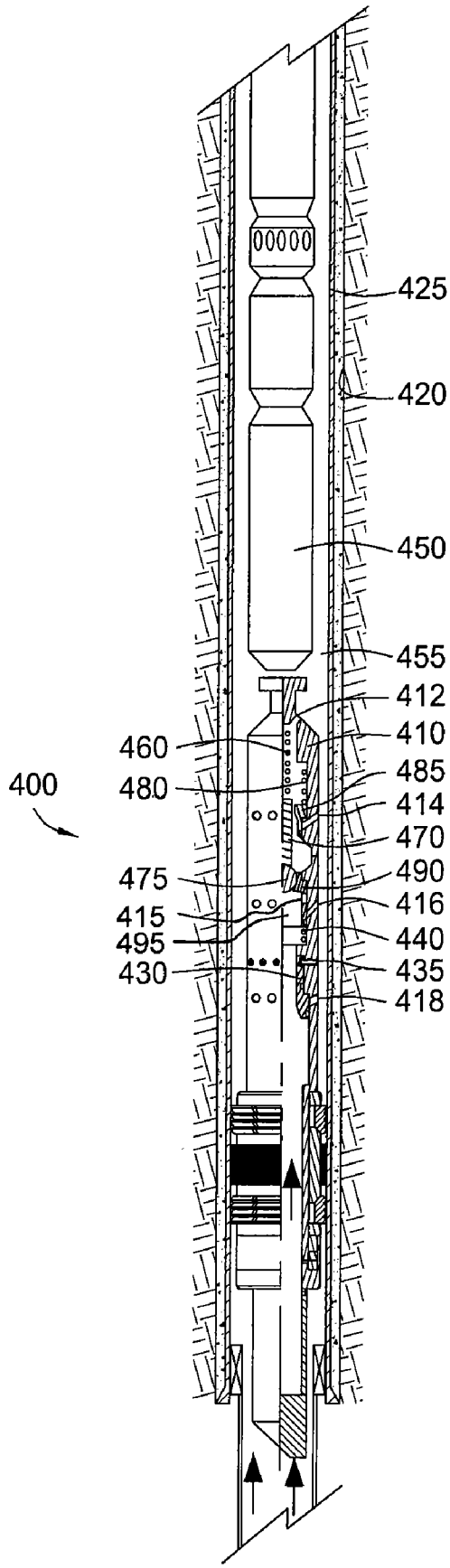
FIG. 4 illustrates a control valve in accordance with still yet another embodiment of the invention.

FIG. 4 illustrates a partial sectional view of a control valve 400 in accordance with one or more embodiments of the invention. Like control valve 100, control valve 400 may be disposed on a string of tubulars inside a casing 425 within a wellbore 420. An electrical submersible pump 450 may be disposed above the control valve 400. The control valve 400 includes a body 410, which includes a first spring 460, a second spring 480 and an upper seat 485 that operate in a manner similar to the first spring 160, the second spring 180 and the upper seat 185, respectively. As such, other details about the operation of the first spring 460, the second spring 480 and the upper seat 485 may be found with reference to the first spring 160, the second spring 180 and the upper seat 185 in the paragraphs above.

The control valve 400 also includes a first port 412 and a second port 414. The first port 412 is configured to allow fluid from an exterior region 455 surrounding the control valve 400 to flow into the control valve 400, and more specifically, a region above sealing member 470. The second port 414 is configured to allow fluid (e.g., formation fluid) from an interior region 495 of the control valve 400 to flow to the exterior region 455 under certain conditions. First port 412 and second port 414 operate in a manner similar to the first port 112 and the second port 114. Accordingly, other details about the operation of the first port 412 and the second port 414 may be found with reference to the first port 112 and the second port 114 in the paragraphs above.

In addition, the control valve 400 includes a third port 416, which may be configured to allow fluid from the exterior region 455 to flow into the interior region 495. In one embodiment, the third port 416 is used to inject acid or other fluids to stimulate the reservoir. The control valve 400 further includes an injection sleeve 490 coupled to a third spring 440. The injection sleeve 490 is moveable against the third spring 440 under certain conditions. The injection sleeve 490 includes an opening 415 therethrough, which is configured to align with the third port 416 when the ball portion 475 pushes the injection sleeve 490 against the third spring 440. As such, the control valve 400 may be configured such that when the pressure of the exterior region 455 exceeds the pressure exerted by the third spring 440 against the injection sleeve 490, the ball portion 475 pushes the injection sleeve 490 against the third spring 440 to align the opening 415 with the third port 416, thereby allowing the fluid from the exterior region 455 to flow into the interior region 495.

The control valve 400 may further include a mechanism for bypassing the control valve 400 in the event that the control valve 400 is inoperational. For instance, if the sealing member 470 or the ball portion 475 becomes inoperational, formation fluid from the reservoir may still be produced to the surface using the bypassing mechanism. In one embodiment, the control valve 400 includes a contingency sleeve 430, which is held by a shear pin 435, and a fourth port 418, which is configured to allow fluid from the exterior region 455 to push the contingency sleeve 430 downward. The control valve 400 may therefore be configured such that when the pressure of the fluid in the exterior region 455 exceeds a shear value of the shear pin 435, the shear pin 435 breaks, thereby allowing the contingency sleeve 430 to drop. In this manner, in the event that the sealing member 470 and/or the ball portion 475 are inoperational, the control valve 400 may be bypassed by injecting fluid with hydrostatic pressure greater than the shear pin 435 into the exterior region 455 to remove the contingency sleeve 430 from blocking the fourth port 418, thereby providing a flow path between the interior region 495 and the exterior region 455. Embodiments of the invention also contemplate other bypassing mechanisms commonly known by persons of ordinary skill in the art, such as rupturable disks and the like.

In one embodiment, the shear value of the shear pin 435 is set to 1000 psi. In another embodiment, the shear value of the shear pin 435 is below the value required to burst the casing 425.

Figure 5:
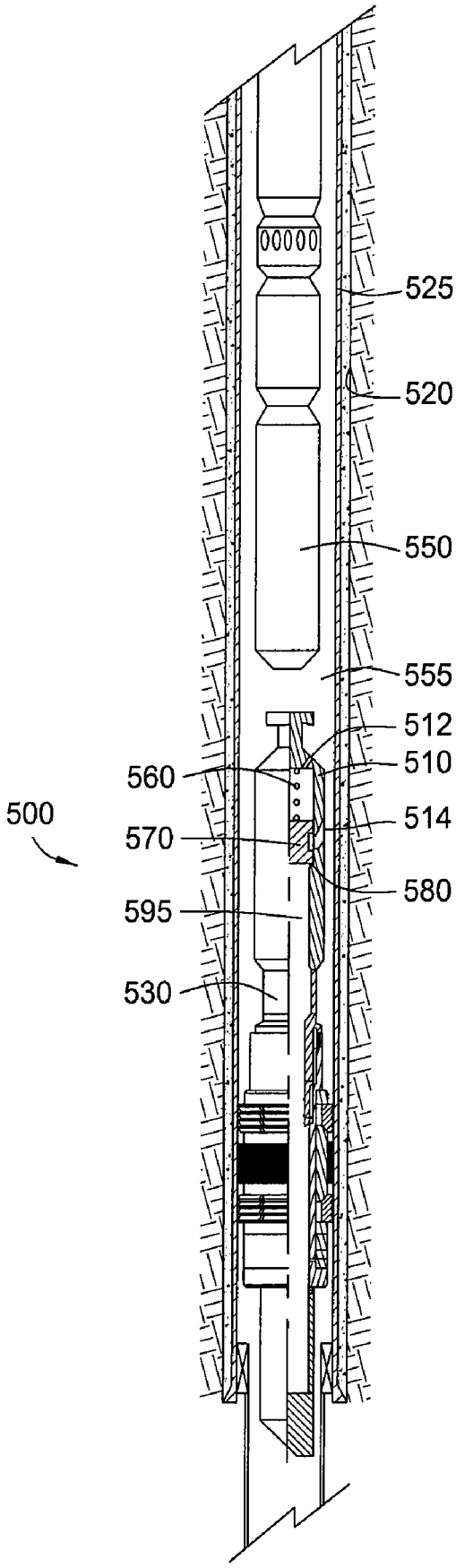
FIG. 5 illustrates a partial section view of a control valve in accordance with one or more embodiments of the invention.

FIG. 5 illustrates a partial section view of a control valve 500 in accordance with one or more embodiments of the invention. The control valve 500 may be disposed on a string of tubulars 530 inside a casing 525 within a wellbore 520. An electrical submersible pump 550 may be disposed above the control valve 500. The control valve 500 includes a body 510, which includes a biasing member 560 configured to bias against a sealing member 570. In one embodiment, the biasing member 560 is configured to exert pressure against the sealing member 570 greater than the pressure of the interior region 595. The control valve 500 further includes a first port 512 for allowing fluid to flow from an exterior region 555 to a region above the sealing member 570. The control valve 500 further includes a second port 514 for providing a flow path from an interior region 595 to the exterior region 555. The interior region 595 is defined as the region below the sealing member 570.

In operation, the sealing member 570 is configured to be held by a stopping member 580, which may also be referred to as a no-go, when the pressure of the interior region 595 is less than the pressure of the exterior region 555. However, the sealing member 570 is configured to axially move inside the body 510 against the biasing member 560 to provide a path for fluid to flow from the interior region 595 to the exterior region 555 at a predetermined pressure difference across the sealing member 570. In one embodiment, the predetermined pressure difference occurs when the pressure of the interior region 595 exceeds the pressure of the exterior region 555 plus the pressure exerted against the sealing member 570 by the biasing member 560. In another embodiment, the predetermined pressure difference occurs when a pump (e.g., an electrical submersible pump) is turned on.

The control valve 500 may also be configured to operate with other features described with reference to the control valve 400. For example, the control valve 500 may include a bypassing mechanism (not shown) configured to allow fluid to flow between the exterior region 555 and the interior region 595 in the event the sealing member 570 becomes inoperational. As another example, the control valve 500 may also include an injection sleeve (not shown) configured to operate with the sealing member 570 to provide a path for fluid to flow from the exterior region 555 to the interior region 595 when the pressure of the exterior region 555 exceeds the pressure of the interior region 595 plus the pressure exerted against the sealing member 570 by a second biasing member (not shown).

While the foregoing is directed to embodiments of the present invention, other and further embodiments of the invention may be devised without departing from the basic scope thereof, and the scope thereof is determined by the claims that follow.

What is claimed is:

1. A valve, comprising:

a body having:

a first seat;

a second seat;

a sealing member movable between the first seat and the second seat, wherein the sealing member is configured to move the second seat against a first biasing member to provide a path for fluid to flow from an interior region of the body to an exterior region of the body at a first predetermined pressure difference across the sealing member; and a second biasing member for biasing the sealing member against the first seat.

2. The valve of claim 1, wherein the first seat is lower than the second seat.

3. The valve of claim 1, wherein the first predetermined pressure difference occurs when the pressure of the interior region exceeds the pressure of the exterior region plus the pressure exerted by the first biasing member against the second seat.

4. The valve of claim 1, further comprising a bypassing mechanism for allowing fluid to flow between the exterior region and the interior region in the event that the sealing member becomes inoperational.

5. The valve of claim 4, wherein the bypassing mechanism comprises:

a lower sleeve;

a shear pin holding the lower sleeve against the body; and a lower port for providing a flow path between the exterior region and the interior region.

6. The valve of claim 5, wherein the lower sleeve is configured to block the lower port in an initial position and is configured to move away from blocking the lower port when the pressure of the exterior region pushing against the lower sleeve is greater than the shear value of the shear pin holding the lower sleeve against the valve.

7. The valve of claim 1, wherein the body further comprises a third biasing member; and wherein the sealing member is configured to move axially against the third biasing member to provide a path for fluid to flow from the exterior region to the interior region at a second predetermined pressure difference across the sealing member.

8. The valve of claim 7, wherein the second predetermined pressure difference occurs when the pressure of the exterior region exceeds the pressure of the interior region plus the pressure exerted against the sealing member by the third biasing member.

9. The valve of claim 7, wherein the body further comprises:

an upper sleeve having a first end and a second end substantially opposite the first end, wherein the upper sleeve comprises an opening therethrough;

wherein the third biasing member biases against the second end of the upper sleeve; and an upper port for providing a path for fluid to flow from the exterior region to the interior region.

10. The valve of claim 9, wherein the sealing member is configured to move axially against the first end such that the opening is aligned with the upper port at the second predetermined pressure difference across the sealing member.

11. The valve of claim 1, wherein the first predetermined pressure difference occurs when a pump is turned on.

12. The valve of claim 11, wherein the pump in an electrical submersible pump.

13. The valve of claim 1, wherein the interior region is positioned below the sealing member.

14. The valve of claim 1, wherein the body has a fishing neck retrievable from the surface.

15. A method for controlling fluid flow between an interior region and an exterior region of a valve, comprising:

disposing the valve inside a wellbore, wherein the valve comprises:

a body having:

a first seat;

a first biasing member biased against the first seat in a first direction;

a sealing member disposed inside the body and configured to seal against the first seat; and a second biasing member biased against the sealing member in the first direction; and moving the first seat in a second direction against the first biasing member to provide a path for fluid to flow from an interior region of the body to an exterior region of the body at a first predetermined pressure difference across the sealing member.

16. The method of claim 15, wherein moving the first seat comprises axially moving the sealing member in the second direction against the first seat.

17. The method of claim 15, wherein the first direction is a downward direction.

18. The method of claim 15, wherein the second direction is an upward direction.

19. The method of claim 15, wherein the first predetermined pressure difference occurs when the pressure of the interior region exceeds the pressure of the exterior region plus the pressure exerted against the sealing member by the first biasing member.

20. The method of claim 15, further comprising axially moving the sealing member in the first direction against a third biasing member disposed inside the body to provide a path for fluid to flow from the exterior region to the interior region at a second predetermined pressure difference across the sealing member.

21. The method of claim 20, wherein the second predetermined pressure difference occurs when the pressure of the exterior region exceeds the pressure of the interior region plus the pressure exerted against the sealing member by the third biasing member.

22. The method of claim 20, wherein axially moving the sealing member in the first direction comprises pushing an upper sleeve against the third biasing member to provide the path for fluid to flow from the exterior region to the interior region at the second predetermined pressure difference across the sealing member.

23. The method of claim 15, further comprising axially moving a lower sleeve disposed inside the body in the first direction to provide a flow path between the exterior region and the interior region when the pressure of the exterior region is greater than the shear value of a shear pin holding the lower sleeve against the body.

24. The method of claim 15, further comprising disposing a pump above the valve inside the wellbore, wherein the first seat is moved in the second direction by turning the pump on.

25. The method of claim 24, wherein the pump in an electrical submersible pump.

26. The method of claim 15, wherein the interior region is positioned below the sealing member.

27. A valve, comprising:

a body having:

a first seat;

a second seat, wherein the first seat is lower than the second seat; and a sealing member movable between the first seat and the second seat, wherein the sealing member is configured to move the second seat against a first biasing member to provide a path for fluid to flow from an interior region of the body to an exterior region of the body at a first predetermined pressure difference across the sealing member.

28. A valve, comprising:

a body having:

a first seat;

a second seat;

a sealing member movable between the first seat and the second seat, wherein the sealing member is configured to move the second seat against a first biasing member to provide a path for fluid to flow from an interior region of the body to an exterior region of the body at a first predetermined pressure difference across the sealing member; and a second biasing member, wherein the sealing member is configured to move axially against the second biasing member to provide a path for fluid to flow from the exterior region to the interior region at a second predetermined pressure difference across the sealing member.

29. The valve of claim 28, wherein the second predetermined pressure difference occurs when the pressure of the exterior region exceeds the pressure of the interior region plus the pressure exerted against the sealing member by the second biasing member.

30. The valve of claim 28, wherein the body further comprises:

an upper sleeve having a first end and a second end substantially opposite the first end, wherein the upper sleeve comprises an opening therethrough;

wherein the second biasing member biases against the second end of the upper sleeve; and an upper port for providing a path for fluid to flow from the exterior region to the interior region.

31. The valve of claim 30, wherein the sealing member is configured to move axially against the first end such that the opening is aligned with the upper port at the second predetermined pressure difference across the sealing member.

32. A valve, comprising:

a body having:

a first seat;

a second seat; and a sealing member movable between the first seat and the second seat, wherein the sealing member is configured to move the second seat against a first biasing member to provide a path for fluid to flow from an interior region of the body to an exterior region of the body at a first predetermined pressure difference across the sealing member, and wherein the first predetermined pressure difference occurs when an electrical submersible pump is turned on.

33. A valve, comprising:

a body having:

a first seat;

a second seat; and a sealing member movable between the first seat and the second seat, wherein the sealing member is configured to move the second seat against a first biasing member to provide a path for fluid to flow from an interior region of the body to an exterior region of the body at a first predetermined pressure difference across the sealing member, and wherein the interior region is positioned below the sealing member.

34. A valve, comprising:

a body having:

a first seat;

a second seat; and a sealing member movable between the first seat and the second seat, wherein the sealing member is configured to move the second seat against a first biasing member to provide a path for fluid to flow from an interior region of the body to an exterior region of the body at a first predetermined pressure difference across the sealing member; and a fishing neck retrievable from the surface.

35. A method for controlling fluid flow between an interior region and an exterior region of a valve, comprising:

disposing the valve inside a wellbore, wherein the valve comprises:

a body having:

a first seat;

a first biasing member biased against the first seat in a downward direction; and a sealing member disposed inside the body and configured to seal against the first seat; and moving the first seat in a second direction against the first biasing member to provide a path for fluid to flow from an interior region of the body to an exterior region of the body at a first predetermined pressure difference across the sealing member.

36. A method for controlling fluid flow between an interior region and an exterior region of a valve, comprising:

disposing the valve inside a wellbore, wherein the valve comprises:

a body having:

a first seat;

a first biasing member biased against the first seat in a first direction; and a sealing member disposed inside the body and configured to seal against the first seat; and moving the first seat in an upward direction against the first biasing member to provide a path for fluid to flow from an interior region of the body to an exterior region of the body at a first predetermined pressure difference across the sealing member.

37. A method for controlling fluid flow between an interior region and an exterior region of a valve, comprising:

disposing the valve inside a wellbore, wherein the valve comprises:

a body having:

a first seat;

a first biasing member biased against the first seat in a first direction; and a sealing member disposed inside the body and configured to seal against the first seat;

moving the first seat in a second direction against the first biasing member to provide a path for fluid to flow from an interior region of the body to an exterior region of the body at a first predetermined pressure difference across the sealing member; and axially moving the sealing member in the first direction against a second biasing member disposed inside the body to provide a path for fluid to flow from the exterior region to the interior region at a second predetermined pressure difference across the sealing member.

38. The method of claim 37, wherein the second predetermined pressure difference occurs when the pressure of the exterior region exceeds the pressure of the interior region plus the pressure exerted against the sealing member by the second biasing member.

39. The method of claim 37, wherein axially moving the sealing member in the first direction comprises pushing an upper sleeve against the second biasing member to provide the path for fluid to flow from the exterior region to the interior region at the second predetermined pressure difference across the sealing member.

40. A method for controlling fluid flow between an interior region and an exterior region of a valve, comprising:

disposing the valve inside a wellbore, wherein the valve comprises:

a body having:

a first seat;

a first biasing member biased against the first seat in a first direction; and a sealing member disposed inside the body and configured to seal against the first seat;

moving the first seat in a second direction against the first biasing member to provide a path for fluid to flow from an interior region of the body to an exterior region of the body at a first predetermined pressure difference across the sealing member; and axially moving a lower sleeve disposed inside the body in the first direction to provide a flow path between the exterior region and the interior region when the pressure of the exterior region is greater than the shear value of a shear pin holding the lower sleeve against the body.

41. A method for controlling fluid flow between an interior region and an exterior region of a valve, comprising:

disposing the valve inside a wellbore, wherein the valve comprises:

a body having:

a first seat;

a first biasing member biased against the first seat in a first direction; and a sealing member disposed inside the body and configured to seal against the first seat;

disposing a pump above the valve inside the wellbore;

moving the first seat in a second direction against the first biasing member by turning the pump on to provide a path for fluid to flow from an interior region of the body to an exterior region of the body at a first predetermined pressure difference across the sealing member.

42. The method of claim 41, wherein the pump in an electrical submersible pump.

43. A method for controlling fluid flow between an interior region and an exterior region of a valve, comprising:

disposing the valve inside a wellbore, wherein the valve comprises:

a body having:

a first seat;

a first biasing member biased against the first seat in a first direction; and a sealing member disposed inside the body and configured to seal against the first seat; and moving the first seat in a second direction against the first biasing member to provide a path for fluid to flow from an interior region of the body to an exterior region of the body at a first predetermined pressure difference across the sealing member, wherein the interior region is positioned below the sealing member.

* * * * *

UNITED STATES PATENT AND TRADEMARK OFFICE

CERTIFICATE OF CORRECTION

PATENT NO. : 8,002,039 B2
APPLICATION NO. : 12/365634
DATED : August 23, 2011
INVENTOR(S) : Robert J. Coon et al.

It is certified that error appears in the above-identified patent and that said Letters Patent is hereby corrected as shown below:

In the Claims:

Column 7, Claim 12, Line 31, please delete "pump in" and insert --pump is--.

Column 8, Claim 25, Line 25, please delete "pump in" and insert --pump is--.

Column 11, Claim 42, Line 12, please delete "pump in" and insert --pump is--.

Signed and Sealed this
Nineteenth Day of February, 2013

Teresa Stanek Rea
*Acting Director of the United States Patent and Trademark Office*